US011959022B2

(12) United States Patent
Al-Hashmy et al.

(10) Patent No.: US 11,959,022 B2
(45) **Date of Patent: *Apr. 16, 2024**

(54) EXTRUDER SYSTEMS AND PROCESSES FOR PRODUCTION OF PETROLEUM COKE AND MESOPHASE PITCH

(71) Applicant: Saudi Arabian Oil Company, Dhahran (SA)

(72) Inventors: Hasan Ali Al-Hashmy, Dhahran (SA); Ibrahim Al-Nutaifi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 172 days.

This patent is subject to a terminal disclaimer.

(21) Appl. No.: 17/534,178

(22) Filed: Nov. 23, 2021

(65) Prior Publication Data

US 2023/0159828 A1 May 25, 2023

(51) Int. Cl.

| | |
|---|---|
| ***C10B 31/06*** | (2006.01) |
| ***C10B 37/04*** | (2006.01) |
| ***C10B 57/00*** | (2006.01) |
| ***C10B 57/04*** | (2006.01) |
| ***D01F 9/155*** | (2006.01) |
| ***D01F 9/32*** | (2006.01) |

(52) U.S. Cl.

CPC ..... *C10B 31/06* (2013.01); *C10B 37/04* (2013.01); *C10B 57/005* (2013.01); *C10B 57/04* (2013.01); *D01F 9/155* (2013.01); *D01F 9/322* (2013.01)

(58) Field of Classification Search

CPC ..... D01F 9/322; D01F 9/155; D01D 1/00; C10C 3/002; C10B 31/006; C10B 37/04; C10B 57/005; C10B 57/04; C10G 9/00; C10G 9/24; C10G 2300/1077

See application file for complete search history.

(56) References Cited

U.S. PATENT DOCUMENTS

| | | | | |
|---|---|---|---|---|
| 3,787,541 | A * | 1/1974 | Grindstaff | C01B 32/00 423/448 |
| 4,206,713 | A | 6/1980 | Ryason | |
| 4,216,074 | A | 8/1980 | Simone | |
| 4,302,324 | A | 11/1981 | Chen et al. | |
| 4,584,060 | A * | 4/1986 | Winckler | C10B 7/10 201/35 |

(Continued)

FOREIGN PATENT DOCUMENTS

| | | |
|---|---|---|
| CN | 212687968 U | 3/2021 |
| EP | 0250136 B1 | 2/1992 |

(Continued)

*Primary Examiner* — Prem C Singh
*Assistant Examiner* — Brandi M Doyle
(74) *Attorney, Agent, or Firm* — Bracewell LLP; Constance G. Rhebergen; Eleanor T. Porter

(57) ABSTRACT

Systems and methods of production for consistently sized and shaped optically anisotropic mesophase pitch from vacuum residue, one method including supplying processed vacuum residue to an extruder; heating the processed vacuum residue throughout a horizontal profile of the extruder from an inlet to an outlet of the extruder; venting hydrocarbon off-gases from the extruder along the horizontal profile of the extruder from the inlet to the outlet of the extruder; and physically shaping the consistently sized and shaped mesophase pitch at the outlet of the extruder for production of carbon fibers.

11 Claims, 3 Drawing Sheets

(56) References Cited

U.S. PATENT DOCUMENTS

| | | | | |
|---|---|---|---|---|
| 4,891,203 | A | 1/1990 | Singer et al. | |
| 5,200,061 | A | 4/1993 | Viscontini | |
| 5,655,835 | A | 8/1997 | Pham et al. | |
| 8,444,828 | B2 * | 5/2013 | Wolfe | F23G 5/0273 201/15 |
| 9,732,278 | B2 | 8/2017 | Kawachi et al. | |
| 2020/0299586 | A1 | 9/2020 | Atkins et al. | |
| 2020/0299588 | A1 | 9/2020 | Goodrich et al. | |

FOREIGN PATENT DOCUMENTS

| | | | |
|---|---|---|---|
| GB | 753084 | A | 7/1956 |
| JP | 2002178388 | A | 6/2002 |

* cited by examiner

EXTRUDER SYSTEMS AND PROCESSES FOR PRODUCTION OF PETROLEUM COKE AND MESOPHASE PITCH

BACKGROUND

Field

The present disclosure relates generally to the production of petroleum coke in oil refining systems and processes, along with mesophase pitch for carbon fiber production. Specifically, the disclosure relates to the use of extruder systems and processes with pitch shapers for the direct production of petroleum coke, mesophase pitch, and carbon fiber material from vacuum residue in a coker fractionator.

Description of the Related Art

Traditionally, heavy vacuum residue produced in oil refining process, such as during vacuum distillation, is sent to delayed coker systems and processes in order to produce a petroleum coke product. For example, vacuum residue from a refining process is sent to a delayed coker stage (described further with regard to FIG. 1) where the vacuum residue is treated at high temperature (about 900° F. to 950° F.) and high pressure (about 15 psig to 90 psig) to produce gases such as fuel gas and liquid propane gas (LPG), coker naphtha, coker gas oils such as light coker gas oil (LCGO) and heavy coker gas oil (HCGO), and petroleum coke.

A delayed coker system or process includes a type of coker which heats a residual oil feed to its thermal cracking temperature in a furnace with multiple parallel passes. This cracks the heavy, long chain hydrocarbon molecules of the residual oil into coker gas oils and petroleum coke. However, these products exhibit market prices that can barely cover the process expenses. Maximizing the consistency and efficiency of coker systems and processes is therefore necessary.

Prior art systems and methods include various means for producing petroleum cokes through traditional delayed coker units. However, prior art systems and methods are inefficient and inconsistent at providing useful petroleum coke, for example as a usable product for carbon fiber manufacture from pitches, including mesophase pitch.

SUMMARY

Embodiments disclosed herein provide extruder systems and processes capable of directly producing petroleum coke in addition to or alternative to optically anisotropic mesophase pitch from vacuum residue processed in a coker fractionator in a consistent and efficient manner compared to traditional delayed coker refining systems and processes. Petroleum coke is widely used by many industries such as steel manufacturing companies due to a high heating value, and carbon fiber manufacture companies use petroleum coke to produce pitch petroleum (such as mesophase pitch) and carbon fiber. Unique thermomechanical extruders (for example regularly cylindrical and/or cone-shaped) enable substantial, surprising, and unexpected reduction in the cost of energy and water consumption versus traditional delayed coker units, and disclosed systems and processes ensure controlled and consistent production (for example with regard to shape and size) of petroleum cokes comprising mesophase pitch.

Embodiments of systems and methods described here allow for the bottom product of vacuum distillation, which is produced at temperature between about 430° C. to about 450° C. and a pressure of about 0.1 kPa, to proceed through a coker fractionator and then direct thermomechanical extrusion, described further with regard to FIGS. 2 and 3. The vacuum residue product processed in one or more extruder is at an elevated temperature and a pressure, which allows the lighter products to be released from controlled venting tubes. In some embodiments, the temperature along a horizontal extruder profile is between about 350° C. (572° F.) to about 450° C. (842° F.). Pressure along the horizontal extruder profile can be between about 0.1 kPa to about 1 kPa. Heated and pressurized extrusion allows for the conversion of vacuum residue product into petroleum coke products comprising mesophase pitch. Two example designs of thermomechanical extruders are discussed, including a regular cylinder-shaped extruder and a cone-shaped extruder, which achieve elevated temperature and pressure ensuring consistent petroleum coke products and maximizing the extraction of light gas products through different stages of venting. Temperature and pressure along the horizontal profile of one or more extrusion unit can be substantially consistent or varied for advantageous extraction of light gas products and production of consistently sized, shaped, and composed petroleum coke.

Consistent petroleum coke products produced here can be used to produce mesophase pitch for production of carbon fibers. Consistent size and shape of produced petroleum cokes is advantageous for distribution of heating capacity for certain end users, such as steel manufacturers, and is also advantageous for carbon fiber production.

Therefore, disclosed here are methods of production for consistently sized and shaped optically anisotropic mesophase pitch from vacuum residue, one method including supplying processed vacuum residue to an extruder; heating the processed vacuum residue throughout a horizontal profile of the extruder from an inlet to an outlet of the extruder; venting hydrocarbon off-gases from the extruder along the horizontal profile of the extruder from the inlet to the outlet of the extruder; and physically shaping the consistently sized and shaped mesophase pitch at the outlet of the extruder for production of carbon fibers. In some embodiments, the method is carried out without the application of steam, hydrogen, or water. Some embodiments of the method include fractionating vacuum residue, produced in a vacuum distillation column at a temperature between about 430° C. to about 450° C. and a pressure of about 0.1 kPa, to remove liquid propane gas, fuel gas, coker naphtha, light coker gas oil, and heavy coker gas oil to produce the processed vacuum reside as a bottom product prior to the step of supplying.

In some embodiments, the step of venting hydrocarbon off-gases from the extruder comprises recycling vented hydrocarbon off-gases to the step of fractionating. Still in other embodiments, the step of venting is carried out in multiple stages along the horizontal profile of the extruder from the inlet to the outlet of the extruder. In certain embodiments, temperature of the extruder at the inlet is between about 550° F. and about 950° F. and decreases gradually along the horizontal profile to the outlet of the extruder to between about 50° F. and about 350° F. Still in other embodiments, the step of physically shaping the consistently sized and shaped mesophase pitch at the outlet of the extruder comprises the use of a shaper selected from the group consisting of: a gradual orientation shaper; a disruption shaper; and a standard shaped shaper.

Some embodiments further include at least one step selected from the group consisting of: spinning the mesophase pitch; thermosetting the mesophase pitch; carbonizing the mesophase pitch; graphitizing the mesophase pitch; surface treatment of the mesophase pitch; epoxy sizing of the mesophase pitch; and spooling of fiber produced from the mesophase pitch. Still in other embodiments, the extruder includes an extrusion screw in an annulus, the extrusion screw selected from the group consisting of: a cylindrically-shaped extrusion screw and a conically-shaped extrusion screw. In certain embodiments, the step of heating the processed vacuum residue throughout a horizontal profile of the extruder from an inlet to an outlet of the extruder comprises a series of variable temperature heaters external to the extruder disposed along the horizontal profile of the extruder.

In some embodiments of the method, the steps of heating and venting require no vacuum or vacuum distillation and wherein coking reactions take place along the entire horizontal profile from the inlet to the outlet of the extruder. Still in other embodiments, the method does not require the application of chemical additives during processing. Some embodiments include the step of hydrogenation to remove sulfur impurities from the mesophase pitch.

Additionally disclosed here are systems for production of consistently sized and shaped optically anisotropic mesophase pitch from vacuum residue, one system including an extrusion system, the extrusion system comprising an extruder fluidly coupled to a processed vacuum residue inlet; heating elements disposed proximate the extrusion system and along a horizontal profile of the extruder from the processed vacuum residue inlet to an outlet of the extruder; a venting zone to remove hydrocarbon off-gases from the extruder along the horizontal profile of the extruder from the processed vacuum residue inlet to the outlet of the extruder; and a physical shaper disposed proximate the outlet of the extruder for shaping the consistently sized and shaped mesophase pitch at the outlet of the extruder for production of carbon fibers. In some embodiments, the system operates without the application of steam, hydrogen, or water.

Some embodiments of the system include a coker fractionator operable to fractionate vacuum residue, produced in a vacuum distillation column at a temperature between about 430° C. to about 450° C. and a pressure of about 0.1 kPa, to remove liquid propane gas, fuel gas, coker naphtha, light coker gas oil, and heavy coker gas oil to produce the processed vacuum reside as a bottom product prior for the processed vacuum residue inlet. Still in other embodiments, the venting zone vents hydrocarbon off-gases from the extruder to the coker fractionator. In yet other embodiments, the venting zone comprises multiple vents along the horizontal profile of the extruder from the processed vacuum residue inlet to the outlet of the extruder. Still in other embodiments, temperature of the extruder at the processed vacuum residue inlet is between about 550° F. and about 950° F. and decreases gradually along the horizontal profile to the outlet of the extruder to between about 50° F. and about 350° F.

In certain embodiments, the physical shaper disposed proximate the outlet of the extruder for shaping the consistently sized and shaped mesophase pitch at the outlet of the extruder for production of carbon fibers comprises at least one physical shaper selected from the group consisting of: a gradual orientation shaper; a disruption shaper; and a standard shaped shaper.

In some embodiments, the at least one physical shaper comprises external heating and cooling units to control temperature of the mesophase pitch at the outlet of the extruder for production of carbon fibers. Still in other embodiments, the system further comprises at least one device selected from the group consisting of: a melt spinning device; a thermosetting device; a carbonization device; a graphitization device; a surface treatment device; an epoxy sizing device; and a spooling device for production of fiber produced from the mesophase pitch. In yet other embodiments, the extruder includes an extrusion screw in an annulus, the extrusion screw selected from the group consisting of: a cylindrically-shaped extrusion screw and a conically-shaped extrusion screw. Still in other embodiments, the heating elements comprise a series of variable temperature heaters external to the extruder disposed along the horizontal profile of the extruder. In certain embodiments, the extrusion system and venting zone require no vacuum or vacuum distillation and wherein coking reactions take place along the entire horizontal profile from the inlet to the outlet of the extruder. Still in yet other embodiments, the system does not require the application of chemical additives during processing. Some embodiments include a hydrogenation unit operable to apply hydrogen to remove sulfur impurities from the mesophase pitch.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION

So that the manner in which the features and advantages of the embodiments of systems of and methods of directly producing petroleum coke comprising mesophase pitch from vacuum residue via extrusion, as well as others, which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Figure 1:
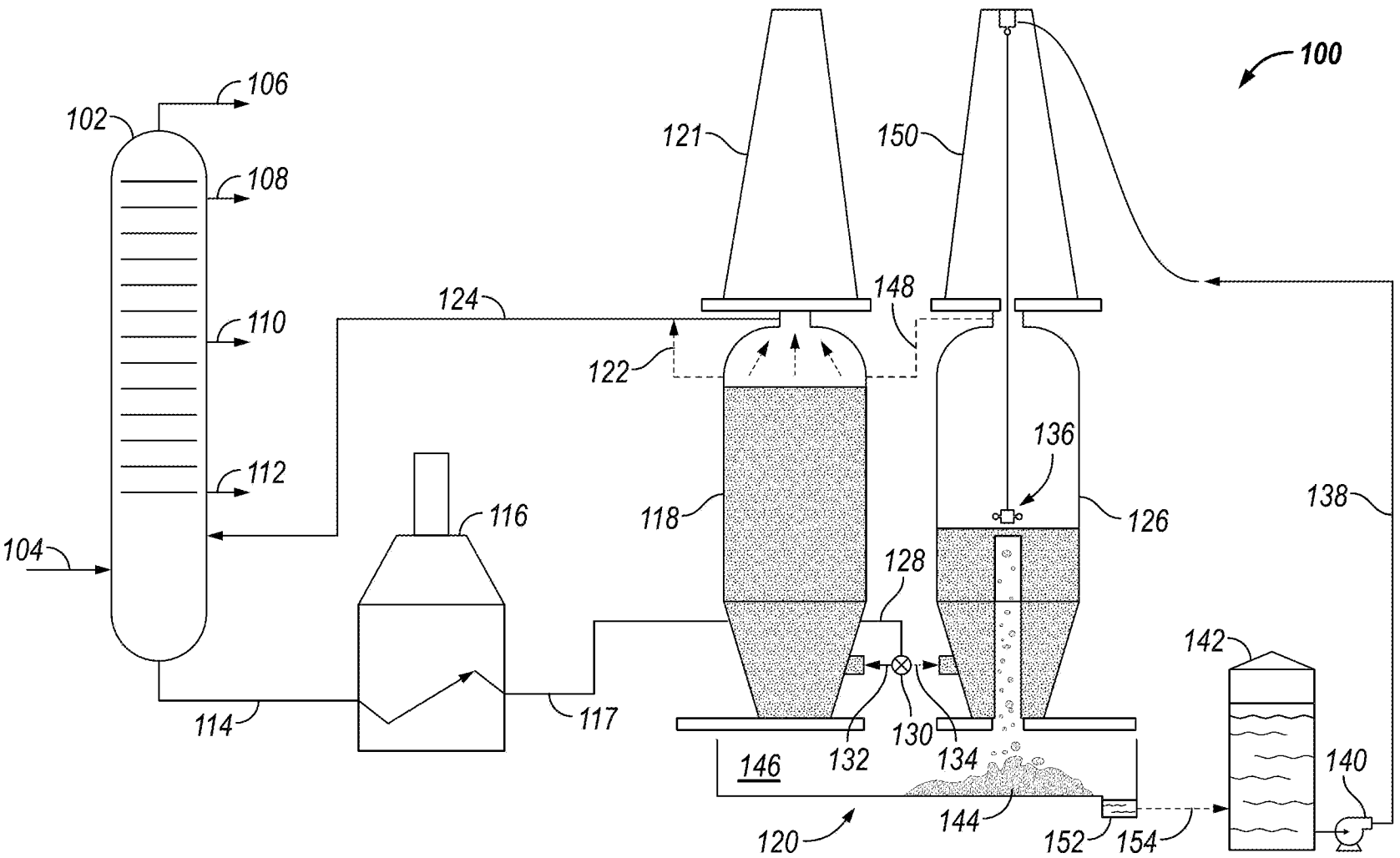
FIG. 1 (Prior Art)
FIG. 1 is a schematic diagram of a prior art system for production of petroleum coke from vacuum residue of oil refining.

FIG. 1 is a schematic diagram of a prior art system for production of petroleum coke from vacuum residue of oil refining. In prior art petroleum coke production system 100, vacuum residue produced during vacuum distillation of refining crude oil enters coker fractionator 102 via stream 104. Vacuum residue can be produced at a temperature between about 430° C. to about 450° C. and a pressure of about 0.1 kPa. Vacuum residue feed temperature to coker fractionator 102 can vary, depending in part on whether feedstock proceeds from interim storage or directly from a vacuum distillation tower. Coker fractionator 102 generally has a fractionator flash zone temperature of about 750° F., or between about 650° F. and about 950° F., or between about 750° F. and about 850° F. The pressure of coker fractionator 102 is dependent, in part, on the pressure in subsequent coking drums, discussed further infra, which can vary from about 25 to about 50 psig. Resulting overhead pressure in coker fractionator 102 can vary between 10 to 35 psig, for example.

Products that can be recovered from coker fractionator 102 include: liquid propane gas (LPG) and fuel gas (FG) for use in fuel or other products from stream 106; coker naphtha for use in other refinery units for processing into gasoline from stream 108; light coker gas oil (LCGO) from stream 110 and heavy coker gas oil (HCGO) from stream 112, which are sent elsewhere in a refinery for hydrotreating and further processing into diesel, gasoline, and other products.

Heavy bottoms stream 114 provides feed to coker furnace 116. Coker furnace 116 heats heavy liquid material from stream 114 and the bottom of coker fractionator 102 to a temperature in excess of about 900° F. (480° C.). Heating causes heavy bottoms stream 114 to crack or chemically react into a combination of smaller hydrocarbon compounds. Steam can be injected to coker furnace 116 to reduce cracking until the heavy bottoms stream 114 reaches coking drums, where cracking and coke formation is desired. Cracking in coker furnace 116 and heavy bottoms stream 114 are undesirable because this can reduce yields and require more frequent furnace de-coking.

Heated heavy bottoms product stream 117 proceeds from coker furnace 116 to first coking drum 118, in the embodiment shown the operating drum. Coker units typically include 2 or more coke drums which operate in pairs in a semi-batch mode. In first coking drum 118, heated heavy bottoms product stream 117 from coker furnace 116 (at high temperature and low pressure) is injected into the bottom of first coking drum 118 and cracked into both products which are returned to coker fractionator 102 for recovery, and petroleum coke that solidifies in the drum. All of the heat necessary for coking is provided in coker furnace 116, whereas coking, or solidification of petroleum coke and separation of hydrocarbon off-gases, takes place in the coke drum, which is why the process is commonly referred to as delayed coking.

In second coking drum 126, or the cutting drum as shown in FIG. 1, the drum is treated with steam, vented, and partially cooled prior to second coking drum 126 being opened to the atmosphere. After second coking drum 126 is opened, solid petroleum coke is cut from the drum using high pressure water. A jet water pump 140 produces high pressure water in stream 138 from water in tank 142, and high pressure water in stream 138 is fed to a rotating cutting bit 136 for cutting solidified petroleum coke product. Rotating cutting bit 136 is lowered and raised within second coking drum 126. Petroleum coke products produced in the prior art, typically referred to as coke, can be similar to coal and are commonly blended with coal and used as fuel in power industrial plants. Petroleum coke has a high fuel value and can burn much hotter than coal.

Produced, inconsistently sized and shaped, coke product and cutting water flow into coke handling system 120 with coke pit 146. Cutting water can be separated and recycled via water collection sump 152 and line 154 to tank 142. Operations are alternated between first coking drum 118 and second coking drum 126. In one drum, petroleum coke and gases are formed via cracking, while in the other drum, solidified petroleum coke is cut via water cutting. The first coking drum 118 and second coking drum 126 in FIG. 1 are interchangeable via streams 128, 132, and 134 along with controllable valve 130. Light hydrocarbon gases produced in first coking drum 118 are partially collected in venting and collection unit 121, and a portion can be recycled to coker fractionator 102 via streams 122, 124. Light hydrocarbon gases produced in second coking drum 126 are partially collected in venting and collection unit 150, and a portion can be recycled to coker fractionator 102 via streams 148, 122, and 124. Overhead products from first coking drum 118 and second coking drum 126 proceed to coker fractionator 102 where LPG and fuel gas, coker naphtha, and heating oil (LCGO and HCGO) fractions are recovered.

Generally pairs of coking drums are required so that while one drum is cracking to produce petroleum coke and hydrocarbon off-gases, the other drum is being cleaned with cutting water to allow continuous processing. Drum operation cycles can last as long as 48 h. Yields and product quality vary widely due to the broad range of feedstock types available for delayed coking units, and there is a decrease in overhead yield with increasing asphaltene content of a given feedstock.

One of many disadvantages of delayed coking systems and processes are that these are thermal cracking process, and are generally more expensive processes than solvent deasphalting. Although coke is oftentimes considered a low-value by-product, when compared to transportation fuels, there is a significant demand for consistent and efficiently-produced high-sulfur petroleum coke.

Hot hydrocarbon product vapors and steam from the top of first coking drum 118 and second coking drum 126 are quenched by incoming feed in stream 104 to coker fractionator 102 to prevent coking in the fractionator and to strip the lighter components of the vacuum residue feed.

Figure 2A:
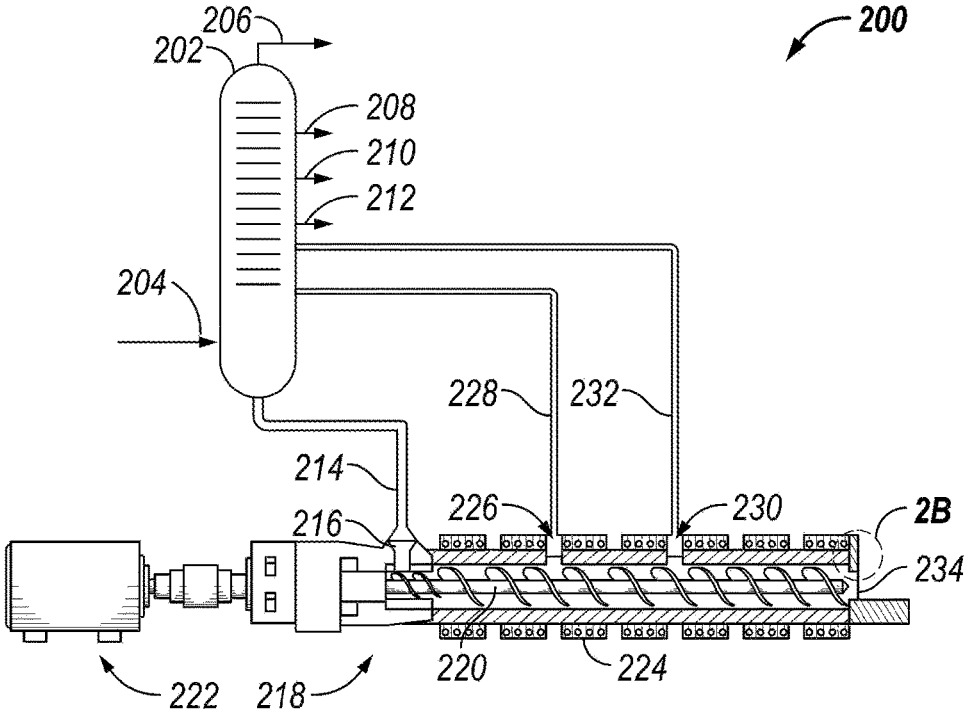
FIG. 2A is a schematic diagram of an embodiment of the present disclosure for direct production of petroleum coke comprising mesophase pitch from vacuum residue of oil refining using an extruder.

FIG. 2A is a schematic diagram of an embodiment of the present disclosure for direct production of petroleum coke comprising mesophase pitch from vacuum residue of oil refining using an extruder. In petroleum coke production system 200, vacuum residue produced during vacuum distillation of refining crude oil enters coker fractionator 202 via stream 204. Vacuum residue can be produced at temperatures between about 430° C. to about 450° C. and a pressure of about 0.1 kPa. Vacuum residue feed temperature to coker fractionator 202 can vary, depending in part on whether feedstock proceeds from interim storage or directly from a vacuum distillation tower. Coker fractionator 202 generally has a fractionator flash zone temperature of about 750° F., or between about 650° F. and about 950° F., or between about 750° F. and about 850° F. The pressure of coker fractionator 202 is dependent, in part, on the pressure in subsequent extrusion units, discussed further infra, which can vary from about 1 to about 50 psig. Resulting overhead pressure in coker fractionator 202 can vary between 10 to 35 psig, for example.

Products that can be recovered from coker fractionator 202 include: liquid propane gas (LPG) and fuel gas (FG) for use in fuel or other products from stream 206; coker naphtha for use in other refinery units for processing into gasoline from stream 208; and light coker gas oil (LCGO) from stream 210 and heavy coker gas oil (HCGO) from stream 212, which are sent elsewhere in a refinery for hydrotreating and further processing into diesel, gasoline, and other products.

Heavy bottoms stream 214 provides a coker-fractionated heavy bottom feed to extrusion system 218 via extruder inlet stream 216. Extrusion system 218 includes in the embodiment shown a cylindrically-shaped extrusion screw 220. Motor 222 controls the rotational speed of extrusion screw 220, and thereby controls the residence time of the coker-fractionated heavy bottom feed within extrusion system 218. As coker-fractionated heavy bottom feed proceeds through extrusion system 218, the temperature profile throughout is controlled by heating elements 224, for example electric or gas heating elements, which allow for controlled heating and a controlled temperature profile throughout extrusion system 218. Residence time can be varied as needed from between about 1 minute and about 1 hour or 1 day, but is surprisingly and unexpectedly less than that required in the embodiment of FIG. 1.

As the coker-fractionated heavy bottom feed proceeds through extrusion system 218, lighter hydrocarbon off-gases are removed and recycled to coker fractionator 202 through first vent 226 and gas recycle line 228 along with second vent 230 and gas recycle line 232. In one embodiment as coker-fractionated heavy bottom feed proceeds through extrusion system 218 from extruder inlet stream 216 to extruder outlet 234 with hydrocarbon off-gases being removed for recycle, the temperature profile along the horizontal width decreases from about between 650° F. and about 950° F. to between about 50° F. and about 350° F. In some embodiments, the temperature along a horizontal extruder profile is between about 350° C. (572° F.) to about 450° C. (842° F.). Pressure along the horizontal extruder profile can be between about 0.1 kPa to about 1 kPa. In one embodiment as coker-fractionated heavy bottom feed proceeds through extrusion system 218 from extruder inlet stream 216 to extruder outlet 234 with hydrocarbon off-gases being removed for recycle, coking reactions occur along the entire horizontal profile of extrusion screw 220 without vacuum being applied and without distillation or vacuum distillation. Overhead products from extrusion system 218 proceed to coker fractionator 202 where LPG and fuel gas, coker naphtha, and heating oil (LCGO and HCGO) fractions are recovered. In some embodiments, no steam, hydrogen, or chemical additives are required throughout extrusion system 218 as coking reactions occur along the entire horizontal profile of extrusion screw 220.

Figure 2B:
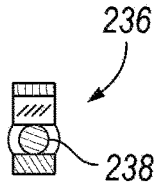
FIG. 2B is a cross section at an outlet of the schematic diagram of FIG. 2A of an embodiment of the present disclosure for direct production of petroleum coke comprising mesophase pitch from vacuum residue of oil refining using an extruder.

At extruder outlet 234, an auto-knife 236 (shown in inlay, FIG. 2B) cuts consistent cross-sections 238 of a cooled, solidified petroleum coke product. Advantageously, the system and process of FIG. 2 is continuous, rather than batch processes of the prior art, and also surprisingly and unexpectedly produces consistently sized and shaped petroleum coke solid for sale and use.

Figure 3A:
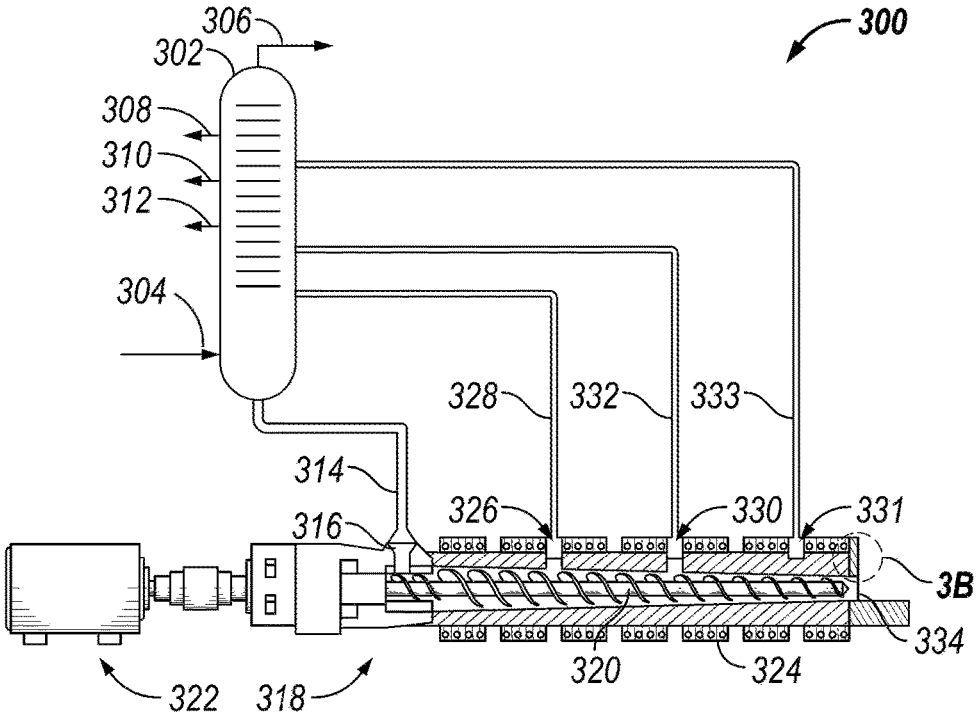
FIG. 3A is a schematic diagram of an embodiment of the present disclosure for direct production of petroleum coke comprising mesophase pitch from vacuum residue of oil refining using a cone-shaped extruder.

FIG. 3A is a schematic diagram of an embodiment of the present disclosure for direct production of petroleum coke from vacuum residue of oil refining using an extruder. In petroleum coke production system 300, vacuum residue produced during vacuum distillation of refining crude oil enters coker fractionator 302 via stream 304. Vacuum residue can be produced at temperatures between about 430° C. to about 450° C. and a pressure of about 0.1 kPa. Vacuum residue feed temperature to coker fractionator 302 can vary, depending in part on whether feedstock proceeds from interim storage or directly from a vacuum distillation tower. Coker fractionator 302 generally has a fractionator flash zone temperature of about 750° F., or between about 650° F. and about 850° F. The pressure of coker fractionator 202 is dependent, in part, on the pressure in subsequent extrusion units, discussed further infra, which can vary from about 1 to about 50 psig. Resulting overhead pressure in coker fractionator 202 can vary between 10 to 35 psig, for example.

Products that can be recovered from coker fractionator 302 include: liquid propane gas (LPG) and fuel gas (FG) for use in fuel or other products from stream 306; coker naphtha for use in other refinery units for processing into gasoline from stream 308; and light coker gas oil (LCGO) from stream 310 and heavy coker gas oil (HCGO) from stream 312, which are sent elsewhere in a refinery for hydrotreating and further processing into diesel, gasoline, and other products.

Heavy bottoms stream 314 provides a coker-fractionated heavy bottom feed to extrusion system 318 via extruder inlet stream 316. Extrusion system 318 includes in the embodiment shown a conical-shaped extrusion screw 320 disposed in a conically-shaped annulus. Motor 322 controls the rotational speed of extrusion screw 320, and thereby controls the residence time of the coker-fractionated heavy bottom feed within extrusion system 318. As coker-fractionated heavy bottom feed proceeds through extrusion system 318, the temperature profile throughout is controlled by heating elements 324, for example gas or electric heating elements, which allow for controlled heating and a controlled horizontal temperature profile throughout extrusion system 318. Residence time can be varied as needed from between about 1 minute and about 1 hour or 1 day, but is surprisingly and unexpectedly less than that required in the embodiment of FIG. 1.

As the coker-fractionated heavy bottom feed proceeds through extrusion system 318, lighter hydrocarbon off-gases are removed and recycled to coker fractionator 302 through first vent 326 and gas recycle line 328 along with second vent 330, gas recycle line 332, vent 331, and gas recycle line 333. In one embodiment as coker-fractionated heavy bottom feed proceeds through extrusion system 318 from extruder inlet stream 316 to extruder outlet 334 with hydrocarbon off-gases being removed for recycle, the temperature profile along the horizontal width decreases from about between 650° F. and about 850° F. or 950° F. to between about 50° F. and about 350° F. Overhead products from extrusion system 318 proceed to coker fractionator 302 where LPG and fuel gas, coker naphtha, and heating oil (LCGO and HCGO) fractions are recovered.

Figure 3B:
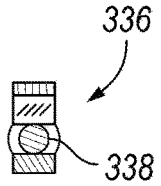
FIG. 3B is a cross section at an outlet of the schematic diagram of FIG. 3A of an embodiment of the present disclosure for direct production of petroleum coke comprising mesophase pitch from vacuum residue of oil refining using a cone-shaped extruder.

At extruder outlet 334, an auto-knife 336 (shown in inlay, FIG. 3B) cuts consistent cross-sections 338 of a cooled, solidified petroleum coke product. In some embodiments, as motor 322 speed is increased, increasing the rotations of extrusion screw 320 and decreasing residence time of the processed vacuum residue in the extruder, the speed of the auto-knife 336 for cutting the consistently sized and shaped petroleum coke can be increased.

Advantageously, the system and process of FIG. 3 is continuous, rather than batch processes of the prior art, and also surprisingly and unexpectedly produces consistently sized and shaped petroleum coke solid, optionally comprising mesophase pitch, for sale and use. For example, the embodiments of FIGS. 2 and 3 can produce consistently sized and shaped petroleum coke disks or pucks, or tubular forms, substantially circular in the cross section and of varying depth based on the speed of the extruder screw and the speed of repetition of an auto-knife. Such consistently sized and shaped disks or pucks increase ease of handling and subsequent use for petroleum coke, for example as use as a fuel in steel production operations.

Embodiments of systems and methods here reduce energy consumption, downtime for maintenance, and costs associated with prior art systems and methods, and allow for consistently sized and shaped solid petroleum coke production. Notably, in some embodiments, no water or steam is required in the extrusion systems, and the systems and processes convert coker-fractionated vacuum residue to petroleum pitch without the application of steam or cutting water.

Crude oil and crude oil residues can be processed through energy intensive refining processes to produce mesophase pitch. The condensed aromatic nature of pitches provides thermal stability, such that mesophase pitch can be melt spun for use in carbon fiber applications. In some instances, melt spinning is preferred to wet/dry spinning, which is used in the production of polyacrylonitrile- (PAN) based fibers and involves large quantities of solvents and waste byproducts. High quality carbon fibers can be produced from optically anisotropic or mesophase pitch (MP), but production of this carbon fiber precursor has required extensive refining and complicated processing, which has made producing carbon fibers from mesophase pitch less desirable than producing PAN-based carbon fibers.

Carbon fibers combine high strength and tensile modulus with other desirable properties such as being lightweight, being chemically inert, having low thermal expansion, and having superior electrical and thermal conductivities. Smaller structural flaws in fiber form and enhanced molecular orientation allow for these properties and make carbon fibers suitable for a number of structural and functional applications.

One challenge, however, to producing carbon fibers from mesophase pitch in a direct crude-oil-to-chemicals (C2C) technology is that about 10-15% of highly viscous hydrotreated (HT) residues produced during crude oil processing (the greater than about 500° C. "cut," or greater than about 500° C. boiling point) will be wasted. Therefore, processing crude oils and crude oil residues to produce mesophase pitch, which has a lower boiling point, is desirable, so it can be used to produce carbon fibers, used as gas oil directly, and used as a feedstock for a cracking process such as fluidized catalytic cracking (FCC).

Desired mesophase pitch products are generally homogeneous and solid at room temperature. The softening point of the mesophase pitch is preferably about 200° C., and in some embodiments is between about 200° C. and 350° C. This range of temperatures for the softening point of mesophase pitch allows for the use of the product in melt spinning production of carbon fibers with advantageous mechanical and thermal properties.

Mesophase pitch produced using embodiments of the present disclosure is a suitable, high-quality precursor for pitch-based carbon fibers. The mesophase pitch obtained includes a suitable amount of alkyl side chains, lower softening point, and an advantageous, consistent crystalline structure identified using a polarized optical microscope and X-ray diffraction (XRD).

The purity of mesophase pitch can be determined by polarized microscopy by counting the percentage of the mesophase areas that reflect the light differently than the "non mesophase" areas. The purity of the mesophase pitch in embodiments of the present disclosure can be greater than about 50%, greater than about 90%, and greater than about 99%. XRD graphs generally show a peak at 25.6, which identifies mesophase pitch carbon material.

Figure 4A:
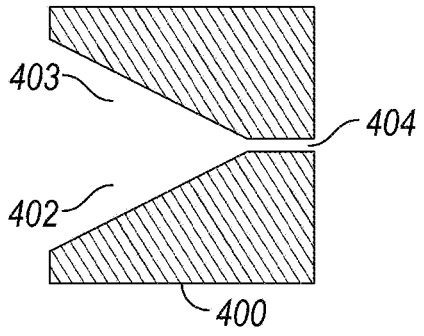
FIGS. 4A, 4B, and 4C show optional shapers or strainers for shaping petroleum pitch and/or mesophase pitch into fiber-like strands for use as and/or production of carbon fibers.
Figure 4B:
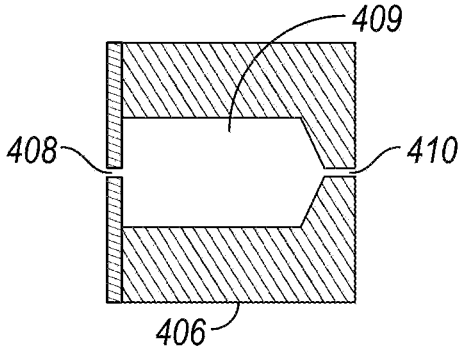
Figure 4C:
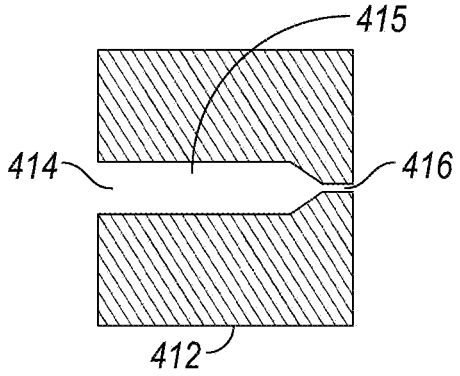

FIGS. 4A, 4B, and 4C show optional shapers or strainers for shaping petroleum pitch and/or mesophase pitch into fiber strands for use as and/or production of carbon fibers. In other words, embodiments of the present disclosure provide for the conversion of vacuum residuum product into mesophase pitch via extrusion and shaping. The conversion to mesophase pitch is achieved at elevated temperature proceeding through an extruder, and then it forms proximate an outlet of an extruder. The mesophase pitch can be directed through a desired shaper or strainer to produce mesophase feedstock for carbon fiber production. Prior art heating and melting stages for petroleum pitch are eliminated.

FIG. 4A shows a gradual orientation shaper or strainer 400 for produced petroleum pitch, which in some embodiments comprises mesophase pitch, for example greater than 50% by weight or greater than 90% by weight mesophase pitch. Petroleum pitch comprising mesophase pitch, for example at extruder outlet 234 or at extruder outlet 334, enters gradual orientation shaper 400 at inlet 402, proceeds through a conical-shaped annulus 403, and then outwardly though narrow outlet 404. Narrow outlet 404 diameter in some embodiments is only between about 1% and about 20% of the diameter of inlet 402. Gradual orientation shaper 400 in some embodiments is removably affixable to extruder outlet 234 or to extruder outlet 334, and the temperature of gradual orientation shaper 400 is controllable by externally disposed heating and/or cooling elements (not pictured).

FIG. 4B shows a disruption orientation shaper or strainer 406 for produced petroleum pitch, which in some embodiments comprises mesophase pitch. Petroleum pitch comprising mesophase pitch, for example at extruder outlet 234 or at extruder outlet 334, enters disruption orientation shaper 406 at narrow inlet 408, proceeds and expands through a cylindrically-shaped annulus with conical end point 409, and then outwardly though narrow outlet 410. Narrow outlet 410 in some embodiments is substantially the same diameter as, within between about 1% and about 10% difference, diameter of narrow inlet 408. Cylindrically-shaped annulus with conical end point 409 can have diameters between about 100% and about 1,000% larger than those of narrow inlet 408 and narrow outlet 410. Disruption orientation shaper 406 in some embodiments is removably affixable to extruder outlet 234 or to extruder outlet 334, and the temperature of disruption orientation shaper 406 is controllable by externally disposed heating and/or cooling elements (not pictured).

FIG. 4C shows a standard orientation shaper or strainer 412 for produced petroleum pitch, which in some embodiments comprises mesophase pitch. Petroleum pitch comprising mesophase pitch, for example at extruder outlet 234 or at extruder outlet 334, enters standard orientation shaper 412 at inlet 414, proceeds through a cylindrically-shaped annulus with conical end point 415, and then outwardly though narrow outlet 416. Narrow outlet 416 diameter in some embodiments is between about 1% and about 20% of the diameter of inlet 414. Cylindrically-shaped annulus with conical end point 415 can have a diameter substantially the same as inlet 414 with gradual conical narrowing to narrow outlet 416. Standard orientation shaper 412 in some embodiments is removably affixable to extruder outlet 234 or to extruder outlet 334, and the temperature of standard orientation shaper 412 is controllable by externally disposed heating and/or cooling elements (not pictured).

The unique thermomechanical extrusion processes of the present disclosure in combination with specifically-shaped shapers or strainers allows direct production of a mesophase pitch feedstock for production of carbon fibers. In the prior art, produced petroleum pitch, for example from the system of FIG. 1, requires melt spinning, thermosetting, carbonization, graphitization, surface treatment, epoxy sizing, and/or spooling. The systems and methods of the present disclosure can eliminate heating processes required for preparing petroleum pitch for production of carbon fibers. For example, the required processes of melt spinning and thermosetting can be eliminated, in some embodiments.

Embodiments described in FIGS. 4A-4C allow for melted/flowable mesophase pitch to proceed directly to a spinning process or a spooling process. Prior art systems and methods for producing pitch precursors require more energy to melt solidified petroleum coke before spinning processes which results in increased cost and time for carbon fiber precursor production. In some embodiments, where sulfur removal is required along with other impurities, a hydrotreatment unit can be applied preceding an extruder of the present disclosure, or in some embodiments hydrogen can be supplied to an extruder for hydrogen treatment and removal of impurities such as sulfur.

Although the disclosure has been described with respect to certain features, it should be understood that the features and embodiments of the features can be combined with other features and embodiments of those features.

Although the disclosure has been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise. The term "about" in some embodiments includes values 5% above or below the value or range of values provided.

As used throughout the disclosure and in the appended claims, the words "comprise," "has," and "include" and all grammatical variations thereof are each intended to have an open, non-limiting meaning that does not exclude additional elements or steps.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

While the disclosure has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present disclosure may suitably comprise, consist or consist essentially of the elements disclosed and may be practiced in the absence of an element not disclosed.

That claimed is:

1. A method of production for consistently sized and shaped optically anisotropic mesophase pitch from vacuum residue, the method comprising the steps of:

fractionating vacuum residue, produced in a vacuum distillation column at a temperature between about 430° C. to about 450° C. and a pressure of about 0.1 kPa, to remove liquid propane gas, fuel gas, coker naphtha, light coker gas oil, and heavy coker gas oil to produce a processed vacuum reside;

supplying the processed vacuum residue to an extruder;

heating the processed vacuum residue throughout a horizontal profile of the extruder from an inlet to an outlet of the extruder, wherein temperature of the extruder at the inlet is about 550° F. and decreases gradually along the horizontal profile to the outlet of the extruder to between about 50° F. and about 350° F., wherein pressure along the horizontal profile of the extruder is between about 0.1 kPa and 1 kPa;

venting hydrocarbon off-gases from the extruder along the horizontal profile of the extruder from the inlet to the outlet of the extruder; and physically shaping the consistently sized and shaped mesophase pitch at the outlet of the extruder for production of carbon fibers.

2. The method according to claim 1, wherein the method is carried out without the application of steam, hydrogen, or water.

3. The method according to claim 1, where the step of venting hydrocarbon off-gases from the extruder comprises recycling vented hydrocarbon off-gases to the step of fractionating.

4. The method according to claim 3, where the step of venting is carried out in multiple stages along the horizontal profile of the extruder from the inlet to the outlet of the extruder.

5. The method according to claim 1, wherein the step of physically shaping the consistently sized and shaped mesophase pitch at the outlet of the extruder comprises the use of a shaper selected from the group consisting of: a gradual orientation shaper; a disruption shaper; and a standard shaped shaper.

6. The method according to claim 1, further comprising at least one step selected from the group consisting of: spinning the mesophase pitch; thermosetting the mesophase pitch; carbonizing the mesophase pitch; graphitizing the mesophase pitch; surface treatment of the mesophase pitch; epoxy sizing of the mesophase pitch; and spooling of fiber produced from the mesophase pitch.

7. The method according to claim 1, wherein the extruder includes an extrusion screw in an annulus, the extrusion screw selected from the group consisting of: a cylindrically-shaped extrusion screw and a conically-shaped extrusion screw.

8. The method according to claim 1, wherein the step of heating the processed vacuum residue throughout a horizontal profile of the extruder from an inlet to an outlet of the extruder comprises a series of variable temperature heaters external to the extruder disposed along the horizontal profile of the extruder.

9. The method according to claim 1, wherein the steps of heating and venting require no vacuum or vacuum distillation and wherein coking reactions take place along the entire horizontal profile from the inlet to the outlet of the extruder.

10. The method according to claim 1, wherein the method does not require the application of chemical additives during processing.

11. The method according to claim 1, further comprising the step of hydrogenation to remove sulfur impurities from the mesophase pitch.

* * * * *